US010607585B2

(12) United States Patent
Kim et al.

(10) Patent No.: US 10,607,585 B2
(45) Date of Patent: Mar. 31, 2020

(54) SIGNAL PROCESSING APPARATUS AND SIGNAL PROCESSING METHOD

(71) Applicant: SONY CORPORATION, Tokyo (JP)

(72) Inventors: Heesoon Kim, Kanagawa (JP); Masahiko Inami, Kanagawa (JP); Kouta Minamizawa, Tokyo (JP); Yuta Sugiura, Tokyo (JP); Mio Yamamoto, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/774,062

(22) PCT Filed: Nov. 1, 2016

(86) PCT No.: PCT/JP2016/082461
§ 371 (c)(1),
(2) Date: May 7, 2018

(87) PCT Pub. No.: WO2017/090387
PCT Pub. Date: Jun. 1, 2017

(65) Prior Publication Data

US 2018/0357988 A1 Dec. 13, 2018

(30) Foreign Application Priority Data

Nov. 26, 2015 (JP) ..... 2015-230515

(51) Int. Cl.
*G10H 1/00* (2006.01)
*G10H 1/02* (2006.01)
(Continued)

(52) U.S. Cl.
CPC ..... *G10H 1/0008* (2013.01); *G10H 1/00* (2013.01); *G10H 1/0091* (2013.01); *G10H 1/02* (2013.01);
(Continued)

(58) Field of Classification Search
CPC ..... G10H 1/0008; G10H 1/00; G10H 1/02; G10H 1/0091; G10H 1/06; G10H 3/14; G10H 7/008
(Continued)

(56) References Cited

U.S. PATENT DOCUMENTS 5,097,326 A * 3/1992 Meijer ..... G09B 21/006 348/62
5,159,140 A 10/1992 Kimpara et al.
(Continued)

FOREIGN PATENT DOCUMENTS

JP 64-091190 A 4/1989
JP 06-296724 A 10/1994
(Continued)

OTHER PUBLICATIONS

International Search Report and Written Opinion of PCT Application No. PCT/JP2016/082461, dated Jan. 24, 2017, 08 pages of ISRWO and 10 pages of English Translation.
(Continued)

*Primary Examiner* — David S Warren
(74) *Attorney, Agent, or Firm* — Chip Law Group

(57) ABSTRACT

Provided is a signal processing device including a control unit that performs a sound signal process on a waveform of a signal generated on a basis of movement of an object, and cause sound corresponding to a signal generated on a basis of the sound signal process to be output within a predetermined period of time. The signal processing device is capable of aurally-exaggerating movement of an object itself and providing the aurally-exaggerated movement of the object by performing a sound signal process on a waveform of a signal generated on the basis of the movement of the object.

13 Claims, 9 Drawing Sheets

(51) Int. Cl.

| | |
|---|---|
| ***G10K 15/04*** | (2006.01) |
| ***G10H 3/14*** | (2006.01) |
| ***G10L 21/003*** | (2013.01) |
| ***G10H 1/06*** | (2006.01) |
| ***G10H 7/00*** | (2006.01) |

(52) U.S. Cl.
CPC ..... *G10H 1/06* (2013.01); *G10H 3/14* (2013.01); *G10H 7/008* (2013.01); *G10K 15/04* (2013.01); *G10L 21/003* (2013.01); *G10H 2220/201* (2013.01); *G10H 2220/391* (2013.01); *G10H 2220/395* (2013.01); *G10H 2220/401* (2013.01); *G10H 2220/455* (2013.01)

(58) Field of Classification Search
USPC ..... 84/604, 615, 622, 626, 653
See application file for complete search history.

(56) References Cited

U.S. PATENT DOCUMENTS 5,214,615 A * 5/1993 Bauer ..... G06F 3/011 367/128
5,371,854 A * 12/1994 Kramer ..... G07C 3/00 704/258
5,587,936 A * 12/1996 Levitt ..... G06F 3/167 703/6
5,730,140 A * 3/1998 Fitch ..... A61B 5/0205 600/514
6,009,394 A * 12/1999 Bargar ..... G06F 3/011 381/17
6,154,723 A * 11/2000 Cox ..... G06F 3/011 345/419
6,388,183 B1 * 5/2002 Leh ..... G10H 1/0008 84/645
7,355,561 B1 * 4/2008 Clarke ..... A63J 25/00 345/1.1
7,511,213 B2 * 3/2009 Childs, Jr. ..... G06Q 40/00 84/600
7,629,528 B2 * 12/2009 Childs, Jr. ..... G06Q 40/00 84/600
9,323,379 B2 * 4/2016 Aubauer ..... G06F 3/0416
9,578,419 B1 * 2/2017 Abel ..... H04R 5/027
9,579,236 B2 * 2/2017 Amedi ..... A61H 3/061
9,646,589 B2 * 5/2017 Ludwig ..... G10H 1/06
9,754,573 B2 * 9/2017 Truchsess ..... G10H 1/32
9,916,011 B1 * 3/2018 Berme ..... G01L 5/16
10,037,186 B2 * 7/2018 Ludwig ..... G10H 1/06
2004/0055447 A1 * 3/2004 Childs, Jr. ..... G06Q 40/00 84/615
2005/0115381 A1 * 6/2005 Bryden ..... A63J 17/00 84/600
2005/0240396 A1 * 10/2005 Childs ..... G10H 1/0025 704/207
2006/0247995 A1 * 11/2006 Childs, Jr. ..... G06Q 40/00 705/35
2009/0000463 A1 * 1/2009 Childs, Jr. ..... G06Q 40/00 84/615
2011/0237367 A1 9/2011 Kodama et al.
2013/0194402 A1 * 8/2013 Amedi ..... A61H 3/061 348/62
2015/0093729 A1 * 4/2015 Plans ..... G06F 16/683 434/236
2017/0047056 A1 * 2/2017 Lee ..... G06F 9/451
2017/0235548 A1 * 8/2017 Ludwig ..... G10H 1/06 84/622
2017/0286056 A1 * 10/2017 Pozos ..... G06T 11/60
2017/0287135 A1 * 10/2017 Pozos ..... G06T 11/60
2018/0247624 A1 * 8/2018 Elkins ..... G10H 1/0025
2018/0247630 A1 * 8/2018 Suitor ..... G10D 13/024
2018/0286370 A1 * 10/2018 Hardi ..... G10D 13/003
2018/0336012 A1 * 11/2018 Ludwig ..... G10H 1/06
2018/0350331 A1 * 12/2018 Hashimoto ..... G10D 13/027
2019/0009133 A1 * 1/2019 Mettler May ..... A63B 24/0062
2019/0279604 A1 * 9/2019 Kato ..... G10D 13/06

FOREIGN PATENT DOCUMENTS

| | | | |
|---|---|---|---|
| JP | 08-019660 | A | 1/1996 |
| JP | 2000-084140 | A | 3/2000 |
| JP | 2007-212635 | A | 8/2007 |
| JP | 2015-126814 | A | 7/2015 |
| WO | 2010/016349 | A1 | 2/2010 |

OTHER PUBLICATIONS

International Preliminary Report on Patentability of PCT Application No. PCT/JP2016/082461, dated Jun. 7, 2018, 05 pages of IPRP and 10 pages of English Translation.

* cited by examiner

SIGNAL PROCESSING APPARATUS AND SIGNAL PROCESSING METHOD

CROSS REFERENCE TO RELATED APPLICATIONS

This application is a U.S. National Phase of International Patent Application No. PCT/JP2016/082461 filed on Nov. 1, 2016, which claims priority benefit of Japanese Patent Application No. JP 2015-230515 filed in the Japan Patent Office on Nov. 26, 2015. Each of the above-referenced applications is hereby incorporated herein by reference in its entirety.

TECHNICAL FIELD

The present disclosure relates to signal processing devices, signal processing methods, and computer programs.

BACKGROUND ART

For example, Patent Literature 1 discloses a technology of controlling change in timbre or sound of an object held by a user in accordance with movement of the user.

CITATION LIST

Patent Literature

Patent Literature 1: JP 2013-228434A

DISCLOSURE OF INVENTION

Technical Problem

However, the technology disclosed in Patent Literature 1 is a technology of changing timbre of a musical instrument serving as the object held by the user, in accordance with movement of the body of the user. Patent Literature 1 does not aurally-exaggerate movement of an object itself or provide the aurally-exaggerated movement of the object.

Accordingly, the present disclosure proposes a novel and improved signal processing device, signal processing method, and computer program that are capable of aurally-exaggerating movement of an object itself and providing the aurally-exaggerated movement of the object.

Solution to Problem

According to the present disclosure, there is provided a signal processing device including a control unit configured to perform a sound signal process on a waveform of a signal generated on a basis of movement of an object, and cause sound corresponding to a signal generated on a basis of the sound signal process to be output within a predetermined period of time.

In addition, according to the present disclosure, there is provided a signal processing method including performing a sound signal process on a waveform of a signal generated on a basis of movement of an object, and causing sound corresponding to a signal generated on a basis of the sound signal process to be output within a predetermined period of time.

In addition, according to the present disclosure, there is provided a computer program causing a computer to perform a sound signal process on a waveform of a signal generated on a basis of movement of an object, and cause sound corresponding to a signal generated on a basis of the sound signal process to be output within a predetermined period of time.

Advantageous Effects of Invention

As described above, the present disclosure provides the novel and improved signal processing device, signal processing method, and computer program that are capable of aurally-exaggerating movement of an object itself and providing the aurally-exaggerated movement of the object.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
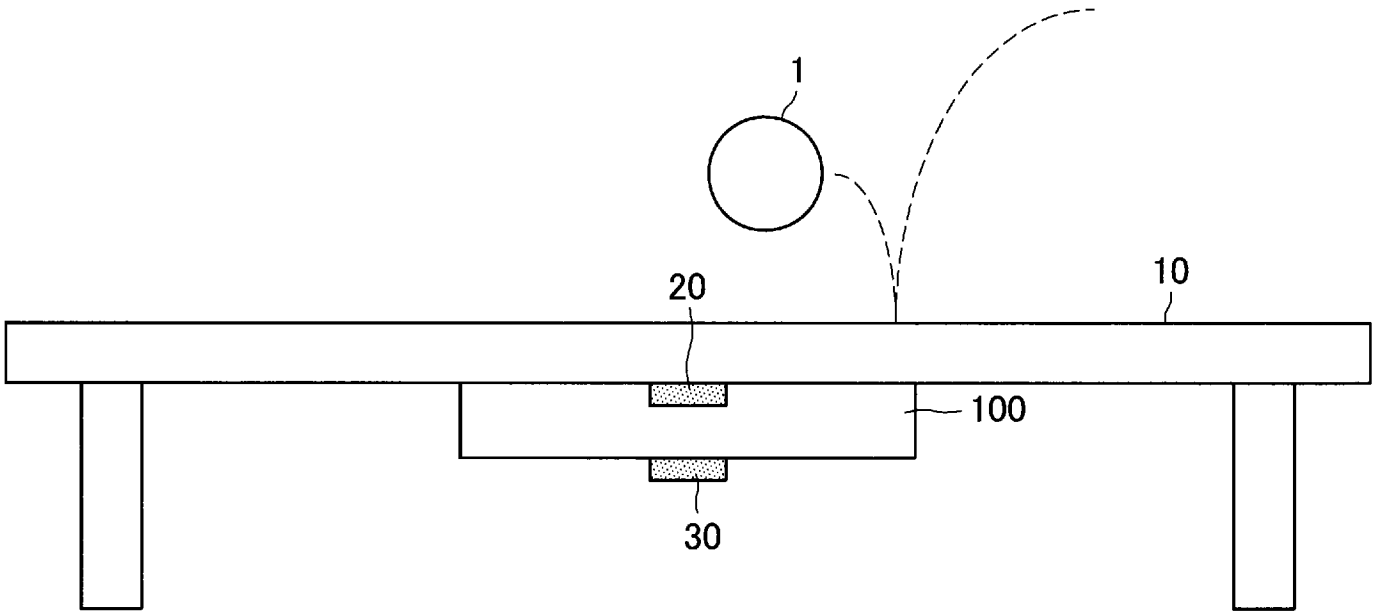
FIG. 1 is an explanatory diagram illustrating an example of a situation in which a signal processing device according to an embodiment of the present disclosure is used.

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

Note that, the description is given in the following order.

1. Embodiment of present disclosure
1.1 Overview
1.2. Configuration example
1.3. Operation example
1.4. Modification
2. Conclusion

1. Embodiment of Present Disclosure

1.1 Overview

First, an overview of a signal processing device according to an embodiment of the present disclosure will be described. The signal processing device according to the embodiment of the present disclosure is a device configured to perform a sound signal process on a waveform of a signal generated on the basis of movement of an object, and cause sound corresponding to a signal generated on the basis of the sound signal process to be output within a predetermined period of time. Examples of the signal generated on the basis of movement of an object may include a signal obtained by collecting wind noise generated when the object transfers, a signal obtained by collecting sound generated from contact of the object with another object, a signal obtained by collecting sound generated when the object transfers on a surface of another object sensing data generated when the object transfers, and the like.

The signal processing device according to the embodiment of the present disclosure is capable of aurally-exaggerating movement of an object itself and providing the aurally-exaggerated movement of the object by performing a sound signal process on a waveform of a signal generated on the basis of the movement of the object and causing sound corresponding to a signal generated on the basis of the sound signal process to be output within a predetermined period of time.

FIG. 1 is an explanatory diagram illustrating an example of a situation in which the signal processing device according to the embodiment of the present disclosure is used. FIG. 1 illustrates an example in which a microphone 20, a speaker 30, and a signal processing device 100 according to the embodiment of the present disclosure are provided on the underside of a tabletop of a table 10.

The microphone 20 collects sound generated when an object comes into contact with the tabletop of the table 10 or when an object transfers on the tabletop of the table 10. FIG. 1 illustrates a state in which an object (ball) 1 is bouncing on the tabletop of the table 10. The microphone 20 collects sound generated when the object 1 bounces on the tabletop of the table 10. The microphone 20 outputs the collected sound to the signal processing device 100.

The signal processing device 100 performs a signal process on the sound collected through the microphone 20. As the signal process to be performed on the sound collected through the microphone 20, the signal processing device 100 may performs amplification or may add an effect (sound effect) or the like.

Next, the signal processing device 100 performs the signal process such as amplification or addition of an effect (sound effect) on the sound collected through the microphone 20, and outputs sound obtained by exaggerating the sound generated when the object comes into contact with the tabletop of the table 10 or when the object transfers on the tabletop of the table 10. Examples of the effect process may include echoing, reverberation, modulation using low frequency, change in speed (time stretching), change in pitch (pitch shifting), and the like. Note that, the sound amplification process may be considered as one of the effect processes.

The signal processing device 100 according to the embodiment of the present disclosure is capable of aurally-exaggerating movement of an object itself and providing the aurally-exaggerated movement of the object by performing the signal process such as addition of an effect on sound collected through the microphone 20 and generating another signal, that is, a sound signal that represents exaggerated sound generated when the object comes into contact with the tabletop of the table 10 or when the object transfers on the tabletop of the table 10. As the effect process, the signal processing device 100 may perform additive synthesis or subtractive synthesis of an oscillator (sine wave, sawtooth wave, triangle wave, square wave, or the like) or a filter effect such as a low-pass filter, a high-pass filter, or a band-pass filter.

The speaker 30 outputs sound based on the sound signal generated through the signal process performed by the signal processing device 100. As described above, it is possible to aurally-exaggerate sound generated when an object transfers on the tabletop of the table 10 and provide the aurally-exaggerate sound since the speaker 30 is provided on the underside of the tabletop of the table 10.

Needless to say, it is not necessary for the signal processing device 100 to be provided on the table 10. For example, an information processing device such as a smartphone, a tablet terminal, a personal computer, or the like may receive sound collected through the microphone 20, and the information processing device that has received the sound collected through the microphone 20 may perform the above-described signal process and transmit a sound signal subjected to the signal process to the speaker 30.

The overview of the signal processing device according to the embodiment of the present disclosure has been described above. Next, a functional configuration example of the signal processing device according to the embodiment of the present disclosure will be described.

1.2. Configuration Example

Figure 2:
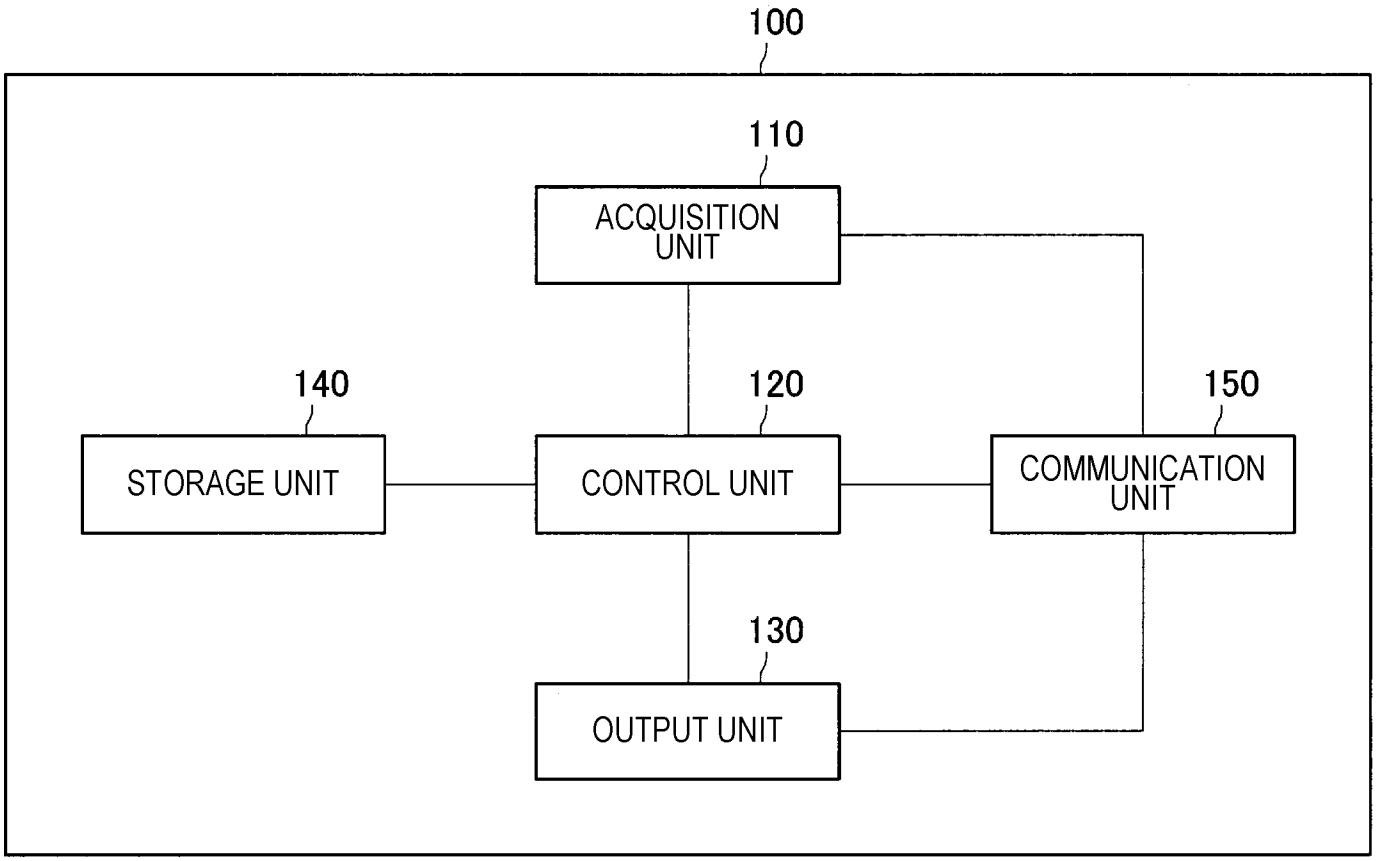
FIG. 2 is an explanatory diagram illustrating a functional configuration example of a signal processing device 100 according to the embodiment of the present disclosure.

FIG. 2 is an explanatory diagram illustrating a functional configuration example of the signal processing device 100 according to the embodiment of the present disclosure. The signal processing device 100 illustrated in FIG. 2 is a device configured to aurally-exaggerate movement of an object itself and provide the aurally-exaggerated movement of the object by performing a sound signal process on a waveform of a signal generated on the basis of the movement of the object and causing sound corresponding to a signal generated on the basis of the sound signal process to be output within a predetermined period of time. Next, a functional configuration example of the signal processing device 100 according to the embodiment of the present disclosure will be described with reference to FIG. 2.

As illustrated in FIG. 2, the signal processing device 100 according to the embodiment of the present disclosure includes an acquisition unit 110, a control unit 120, an output unit 130, a storage unit 140, and a communication unit 150.

The acquisition unit 110 acquires a signal generated on the basis of movement of an object, from an outside. For example, from the microphone 20 illustrated in FIG. 1, the acquisition unit 110 acquires a sound signal of sound generated when an object comes into contact with the tabletop of the table 10 or when an object transfers on the tabletop of the table 10. The acquisition unit 110 outputs the acquired signal to the control unit 120.

For example, the control unit 120 includes a processor, a storage medium, and the like. Examples of the processor include a central processing unit (CPU), a digital signal processor (DSP), and the like. Examples of the storage medium include read only memory (ROM), random access memory (RAM), and the like.

The control unit 120 performs a signal process on the signal acquired by the acquisition unit 110. For example, the control unit 120 performs the signal process on the sound signal of the sound generated when the object comes into contact with the tabletop of the table 10 or when the object transfers on the tabletop of the table 10. For example, as the signal process performed on a sound signal output from the acquisition unit 110, the control unit 120 performs an amplification process, a predetermined effect process, or the like on at least a part of a frequency band. As described above, the amplification process may be considered as one of effect processes. When the sound signal output from the acquisition unit 110 is subjected to the signal process, the control unit 120 outputs the signal subjected to the signal process to the output unit 130 within a predetermined period of time, or preferably in almost real time.

The control unit 120 is capable of deciding content of the signal process in accordance with an object if the object that comes in contact with the tabletop of the table 10 or transfers on the tabletop of the table 10 is already known.

For example, if the object that transfers on the tabletop of the table 10 is a toy car, the control unit 120 may perform a signal process on sound generated on the basis of the transferring object, and perform a signal process for outputting sound like car driving sound (such as engine noise) from the speaker 30.

Alternatively, for example, if the object that transfers on the tabletop of the table 10 is a plastic toy elephant, the control unit 120 may perform a signal process on sound generated on the basis of the transferring object, and perform a signal process for outputting sound "stomp stomp" representing footstep sound of an elephant from the speaker 30.

Alternatively, for example, in the case where a ball is bouncing on the tabletop of the table 10, the control unit 120 may perform a signal process on sound generated on the basis of the contact with the object (the ball that comes into contact with the tabletop of the table 10), and perform a signal process for outputting sound that emphasizes the bounce of the ball from the speaker 30.

The object that comes in contact with the tabletop of the table 10 or transfers on the tabletop of the table 10 may be set in advance by a user, or may be decided by the control unit 120 using a result of image recognition (to be described later).

Even if the object that comes in contact with the tabletop of the table 10 or transfers on the tabletop of the table 10 is already known, it is also possible for the control unit 120 to perform a signal process for outputting sound unrelated to the object from the speaker 30.

For example, even if the object that transfers on the tabletop of the table 10 is a toy car, the control unit 120 may perform a signal process for outputting sound unrelated to the car (such as a sound effect including high-tone sound rather than low-tone sound like engine noise) from the speaker 30 on the basis of the transferring object.

The amount of amplification to be performed on a sound signal output from the acquisition unit 110, a frequency band to be amplified, and content of an effect process may be designated by a user, or may be automatically decided by the control unit 120. In the case where the amount of amplification to be performed on a sound signal output from the acquisition unit 110, a frequency band to be amplified, and content of an effect process are automatically decided by the control unit 120, the control unit 120 may decide them in accordance with content of movement of the object, for example.

The control unit 120 may changes content of the signal process in accordance with content of movement even in the case of an identical object. For example, the control unit 120 may performs signal processes of different contents on an identical object between the case where the object is transferring on the tabletop of the table 10 and the case where the object is bouncing on the tabletop of the table 10.

In the case of the signal process, the control unit 120 may perform a signal process for exaggerating sound generated from an object and outputting the exaggerated sound as combined waves with the sound generated from the object, or may perform a signal process for o canceling sound of an object, exaggerating sound generated from the object, and outputting the exaggerated sound.

In the case of the signal process, the control unit 120 may perform a process of cutting a low frequency band from a sound signal output from the acquisition unit 110 to avoid audio feedback.

The output unit 130 outputs the signal subjected to the signal process performed by the control unit 120, to an external device such as the speaker 30 illustrated in FIG. 1. The speaker 30 receives the signal from the output unit 130, and then outputs sound based on the signal subjected to the signal process performed by the control unit 120.

The storage unit 130 includes a storage medium such as a semiconductor memory or hard disk. The storage unit 130 stores a program and data for processes to be performed by the signal processing device 100. The program and data stored in the storage unit 140 may be read out appropriately when the control unit 120 performs a signal process.

For example, the storage unit 140 stores a parameter for an effect process to be used when the control unit 120 performs the signal process. The storage unit 140 may store a plurality of parameters corresponding to characteristics of objects that hit on or transfer on the tabletop of the table 10.

The communication unit 150 is a communication interface configured to mediate communication between the signal processing device 100 and another device. The communication unit 150 supports any wireless or wired communication protocol, and establishes communication with another device. The acquisition unit 110 may be supplied with data received by the communication unit 150 from another device. In addition, the communication unit 150 may transmits a signal to be output from the output unit 130.

Since the signal processing device 100 according to the embodiment of the present disclosure has the structural elements illustrated in FIG. 2, it is possible to aurally-exaggerate movement of an object itself and provide the aurally-exaggerated movement of the object by performing a sound signal process on a waveform of a signal generated on the basis of the movement of the object and causing sound corresponding to a signal generated on the basis of the sound signal process to be output within a predetermined period of time, or preferably in almost real time.

The functional configuration example of the signal processing device 100 according to the embodiment of the present disclosure has been described with reference to FIG. 2. Next, an operation example of the signal processing device according to the embodiment of the present disclosure will be described.

1.3. Operation Example

Figure 3:
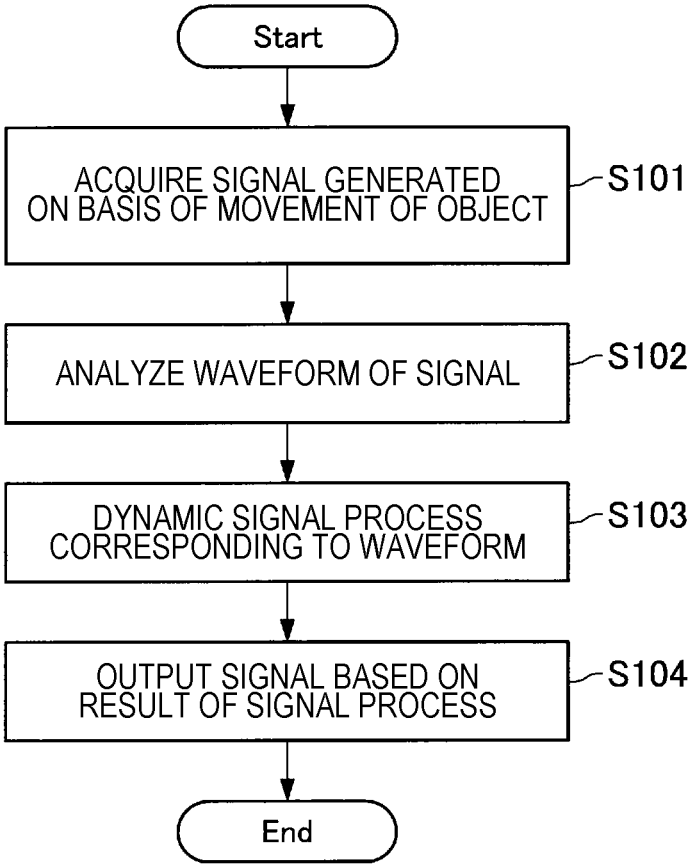
FIG. 3 is a flowchart illustrating an operation example of the signal processing device 100 according to the embodiment of the present disclosure.

FIG. 3 is a flowchart illustrating an operation example of the signal processing device 100 according to the embodiment of the present disclosure. FIG. 3 illustrates an operation example of the signal processing device 100 that acquires a sound signal of sound generated when an object comes into contact with the tabletop of the table 10 or when an object transfers on the tabletop of the table 10, from the microphone 20 illustrated in FIG. 1 and performs a signal process on the sound signal, for example. Next, the operation example of the signal processing device 100 according to the embodiment of the present disclosure will be described with reference to FIG. 3.

When the acquisition unit 110 of the signal processing device 100 acquires a signal generated on the basis of movement of an object (Step S101), the control unit 120 of the signal processing device 100 analyzes a waveform of the acquired signal (Step S102). Next, the control unit 120 of the signal processing device 100 performs a dynamic signal process corresponding to the waveform of the acquired signal (Step S103), and the output unit 130 of the signal processing device 100 outputs a signal based on a result of the signal process within a predetermined period of time, or preferably in almost real time (Step S104).

Since the signal processing device according to the embodiment of the present disclosure operates as illustrated in FIG. 3, it is possible to aurally-exaggerate movement of an object itself and provide the aurally-exaggerated movement of the object by performing a sound signal process on a waveform of a signal generated on the basis of the movement of the object and causing sound corresponding to a signal generated on the basis of the sound signal process to be output within a predetermined period of time, or preferably in almost real time.

1.4. Modifications

Next, modifications of the signal processing device according to the embodiment of the present disclosure will be described. As described above, the control unit 120 is capable of deciding content of the signal process in accordance with a characteristic of an object if the object that comes in contact with the tabletop of the table 10 or transfers on the tabletop of the table 10 is already known. Subsequently, the control unit 120 may recognize the object that comes in contact with the tabletop of the table 10 or transfers on the tabletop of the table 10 by using a result of an image recognition process, for example.

Figure 4:
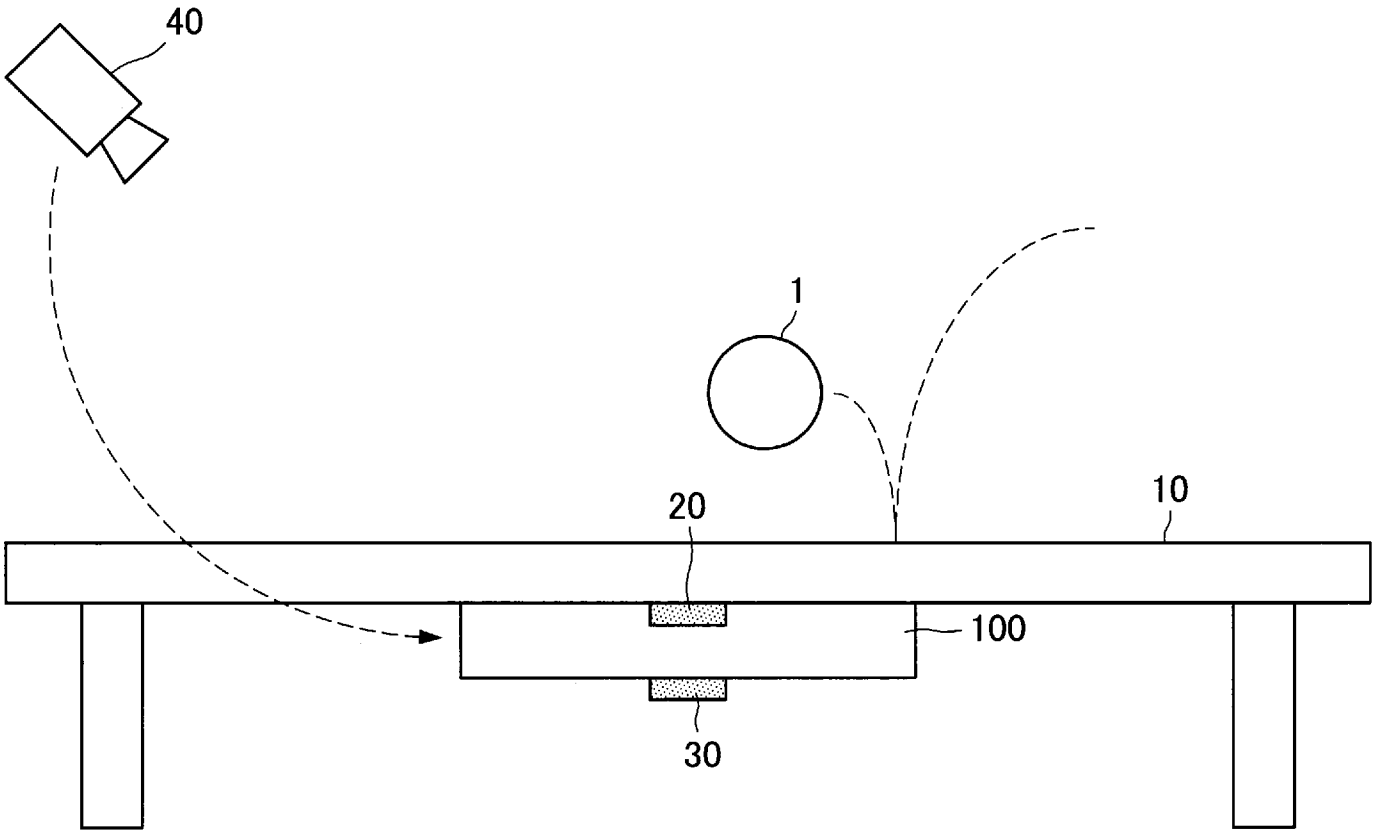
FIG. 4 is an explanatory diagram illustrating a modification of the embodiment of the present disclosure.

FIG. 4 is an explanatory diagram illustrating a modification of the embodiment of the present disclosure. FIG. 4 illustrates an example in which an imaging device 40 is installed in a room with the table 10. The imaging device 40 is configured to capture images of the tabletop of the table 10.

The signal processing device 100 acquires a moving image captured by the imaging device 40 from the imaging device 40. The control unit 120 of the signal processing device 100 analyzes the moving image captured by the imaging device 40. This enables the signal processing device 100 to recognize presence or absence of an object on the tabletop of the table 10, and the shape of the object in the case where there is the object on the tabletop of the table 10. Next, the signal processing device 100 estimates what the object on the tabletop of the table 10 is from the recognized shape of the object, and performs a signal process on the signal acquired by the acquisition unit 110. The signal process corresponds to the estimated object.

It is also possible for the signal processing device 100 to request a user to send feedback about the object on the tabletop of the table 10 estimated through image processing. By requesting a user to send feedback about the object on the tabletop of the table 10 estimated through the image processing, it is possible for the signal processing device 100 to improve accuracy of the estimation of the object from a result of the image recognition.

As a result of analyzing the moving image captured by the imaging device 40, the signal processing device 100 may perform a signal process on the signal acquired by the acquisition unit 100 in accordance with content of colors included in the image. In other words, even the same type of objects make sounds, the signal processing device 100 may perform signal processes on signals acquired by the acquisition unit 110 in accordance with difference in color between the objects.

For example, if the colors in the image include many red colors as a result of analyzing the moving image captured by the imaging device 40, the signal processing device 100 may perform a signal process of emphasizing a low-tone part on the signal acquired by the acquisition unit 110. Alternatively, for example, if the colors in the image include many blue colors as a result of analyzing the moving image captured by the imaging device 40, the signal processing device 100 may perform a signal process of emphasizing a high-tone part on the signal acquired by the acquisition unit 110.

It is also possible for the control unit 120 to estimate what the object that comes in contact with the tabletop of the table 10 or transfers on the tabletop of the table 10 is, from data of mass acquired from a sensor, for example.

Figure 5:
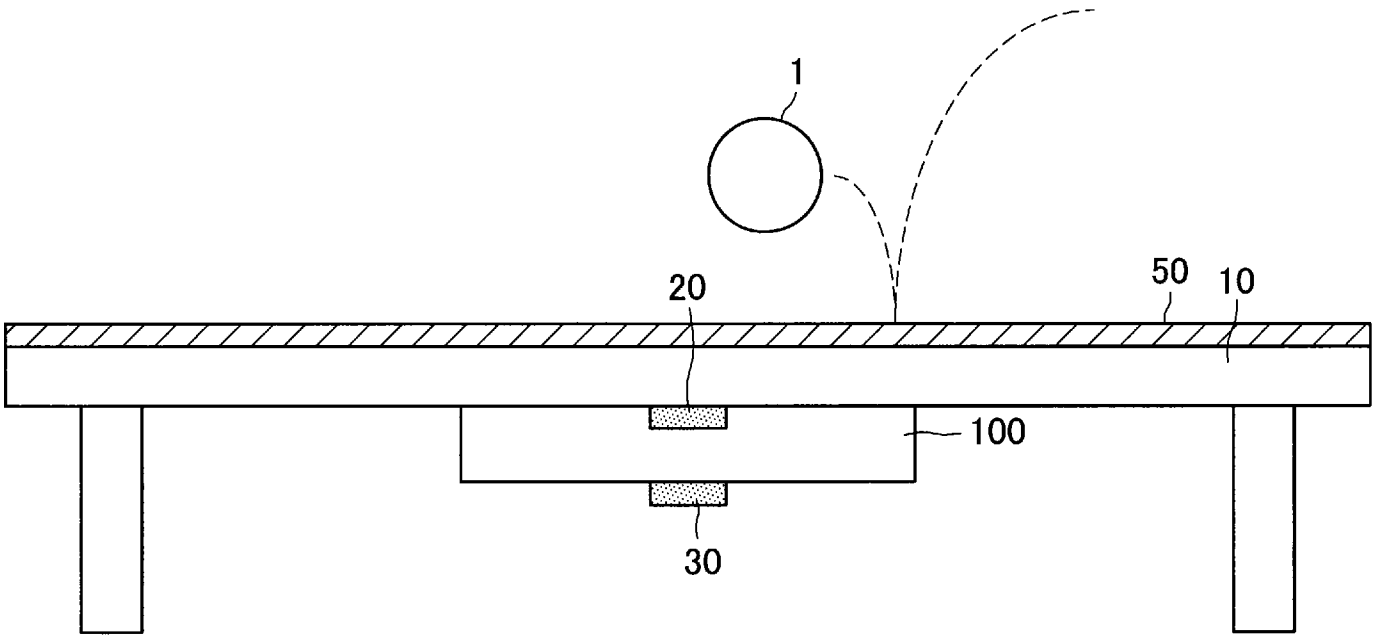
FIG. 5 is an explanatory diagram illustrating a modification of the embodiment of the present disclosure.

FIG. 5 is an explanatory diagram illustrating a modification of the embodiment of the present disclosure. FIG. 5 illustrates an example in which a sensor 50 is installed on the tabletop of the table 10. The sensor 50 is configured to measure mass of an object that is in contact with the tabletop of the table 10.

The sensor 50 detects mass of an object 1 in accordance with contact of the object 1 with its surface, and transmits data of the detected mass to the signal processing device 100. The control unit 120 of the signal processing device 100 analyzes the data of mass transmitted from the sensor 50. This enables the signal processing device 100 to recognize presence or absence of the object on the tabletop of the table 10, and the mass of the object in the case where there is the object on the tabletop of the table 10. Next, the signal processing device 100 estimates what the object on the tabletop of the table 10 is from the mass of the object, and performs a signal process on the signal acquired by the acquisition unit 110. The signal process corresponds to the estimated object.

It is also possible for the signal processing device 100 to request a user to send feedback about the object on the tabletop of the table 10 estimated from the mass of the object or about a result of the signal process performed on sound generated on the basis of movement of the object for the sake of learning. By requesting a user to send feedback about the object on the tabletop of the table 10 estimated through the image processing or about a result of the signal process performed on sound generated on the basis of movement of the object, it is possible for the signal processing device 100 to improve accuracy of the estimation of an object from mass of the object and improve accuracy of the signal process.

Needless to say, it is possible for the signal processing device 100 to combine the estimation of an object from mass of the object and the estimation of an object from a result of image recognition of the object described with reference to FIG. 4.

The signal processing device 100 may perform a signal process on the signal acquired by the acquisition unit 110 in accordance with the size of the object on the tabletop of the table 10 estimated through the image processing. In other words, even the same type of objects make sounds, the signal processing device 100 may perform signal processes on signals acquired by the acquisition unit 110 in accordance with difference in sizes between the objects. For example, the signal processing device 100 may perform a signal process of emphasizing a lower-tone part on the signal acquired by the acquisition unit 110, as the size of the recognized object gets larger as a result of analyzing the moving image captured by the imaging device 40. Alternatively, for example, the signal processing device 100 may perform a signal process of emphasizing a higher-tone part on the signal acquired by the acquisition unit 110, as the size of the recognized object gets smaller as a result of analyzing the moving image captured by the imaging device 40.

In addition, the signal processing device 100 may change content of a sound signal process in accordance with a frequency characteristic of the signal generated on the basis of the movement of the object. For example, if the signal generated on the basis of the movement of the object includes much low-frequency sound, the signal processing device 100 may perform a signal process of amplifying the low-frequency sound. If the signal generated on the basis of the movement of the object includes much high-frequency sound, the signal processing device 100 may perform a signal process of amplifying the high-frequency sound. On the other hand, if the signal generated on the basis of the movement of the object includes much low-frequency sound, the signal processing device 100 may perform a signal process of amplifying the high-frequency sound. If the signal generated on the basis of the movement of the object includes much high-frequency sound, the signal processing device 100 may perform a signal process of amplifying the low-frequency sound.

The positions of the microphone 20 and the speaker 30 installed in the table 10 are not limited to the positions illustrated in FIG. 1.

Figure 6:
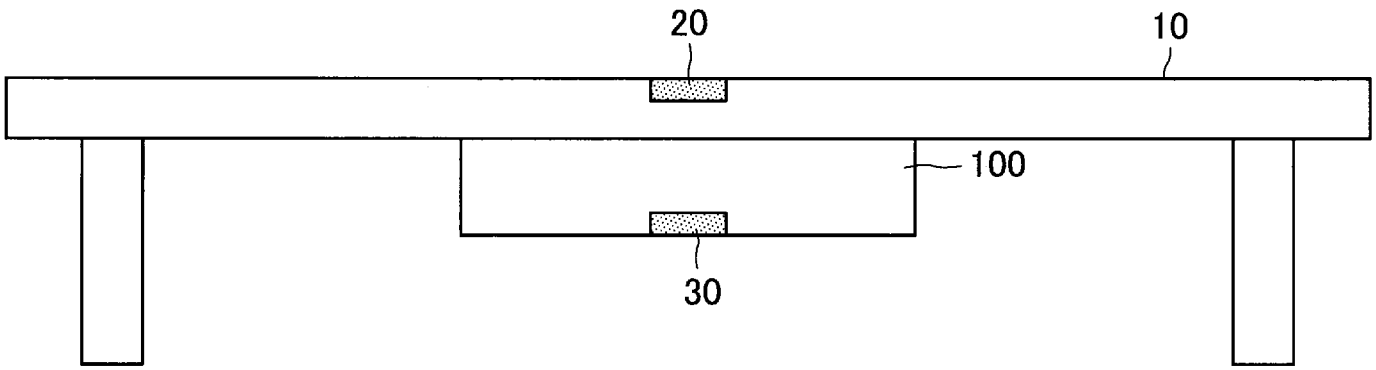
FIG. 6 is an explanatory diagram illustrating a modification of positions of a microphone 0 and a speaker that are installed in a table.

FIG. 6 is an explanatory diagram illustrating a modification of positions of the microphone 20 and the speaker that are installed in the table 10. As illustrated in FIG. 6, the microphone 20 may be embedded in a surface of the tabletop of the table 10. In addition, the speaker 30 may be integrated with the signal processing device 100.

Figure 7:
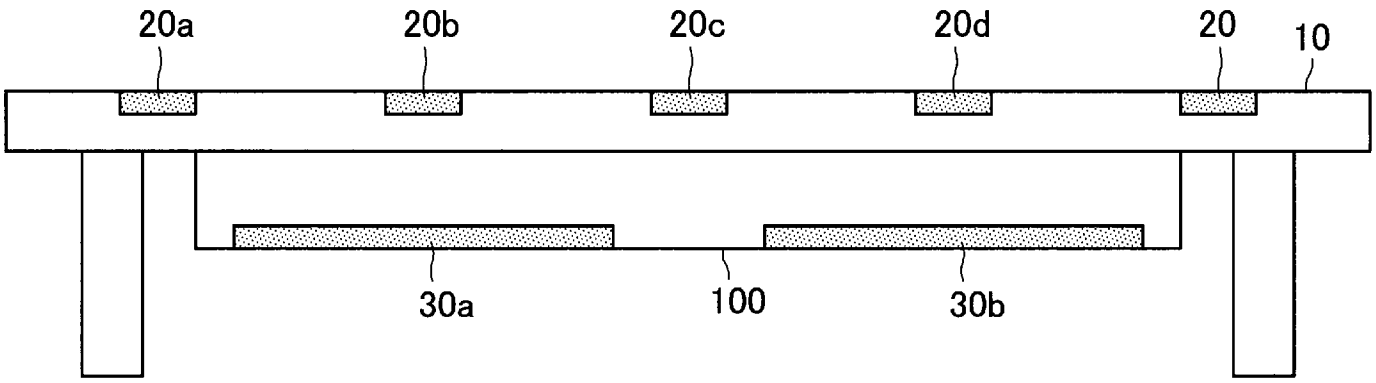
FIG. 7 is a modification of the number of microphones and speakers that are installed in a table.

The number of microphones and the number of speakers are not limited to one. FIG. 7 is an explanatory diagram illustrating a modification of the number of microphones and speakers that are installed in the table 10. FIG. 7 illustrates an example in which five microphones 20*a* to 20*e* are embedded in the surface of the tabletop of the table 10 and two speakers 30*a* and 30*b* are installed in the signal processing device 100.

As described above, the plurality of microphones are embedded in the tabletop of the table 10 and sound is output from the two speakers 30*a* and 30*b*. This enables the signal processing device 100 to perform a signal process of outputting larger sound from a speaker that is closer to a position of the tabletop of the table 10 where the object has come into contact with.

The example has been described above in which the microphone(s) is installed in the tabletop of the table 10, the microphone(s) collects sound generated when an object comes into contact with the tabletop of the table 10 or when the object transfers on the tabletop of the table 10, and the signal process is performed on the collected sound. Next, an example will be described in which a microphone is installed in an object, the microphone collects sound generated when the object transfers, and a signal process is performed on the collected sound.

Figure 8:
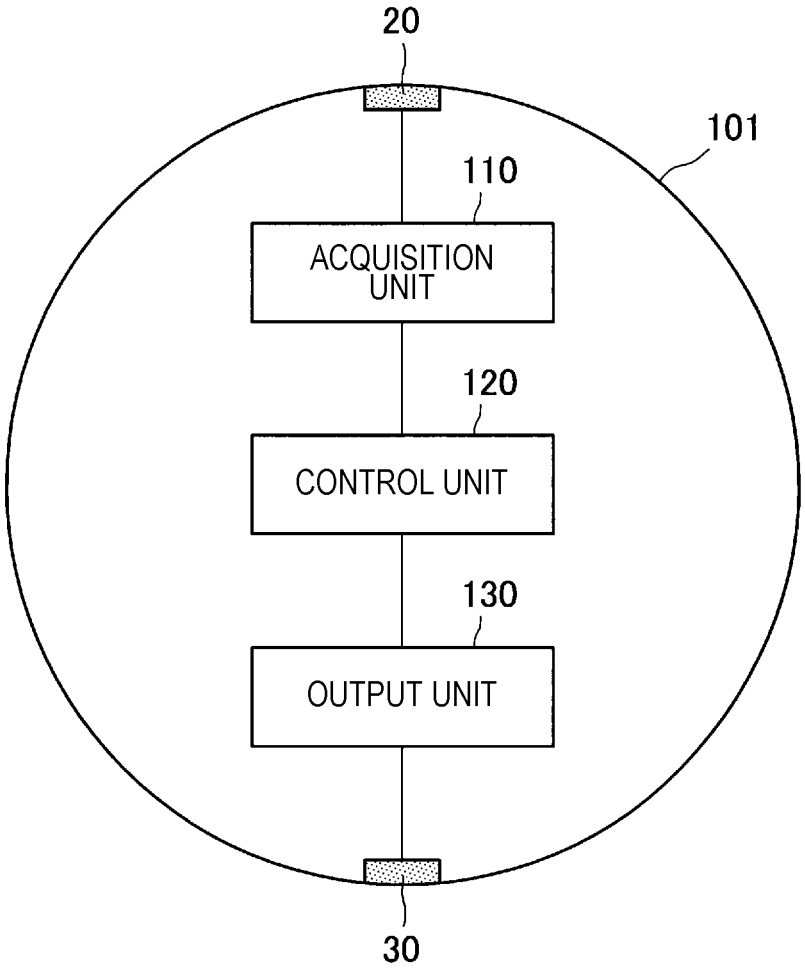
FIG. 8 is an explanatory diagram illustrating a modification of the embodiment of the present disclosure.

FIG. 8 is an explanatory diagram illustrating a modification of the embodiment of the present disclosure. FIG. 8 illustrates an example in which the microphone 20 and the speaker 30 are installed in a surface of a ball 101, and the acquisition unit 110, the control unit 120, and the output unit 130 are installed in the ball 101. The acquisition unit 110, the control unit 120, and the output unit 130 are structural elements of the signal processing device 100 illustrated in FIG. 2.

As illustrated in FIG. 8, the microphone 20 and the speaker 30 are installed in the surface of the ball 101, and the acquisition unit 110, the control unit 120, and the output unit 130 are installed in the ball 101. This enables the ball 101 to output sound from the speaker 30. The sound exaggerates movement of the ball 101.

Figure 9:
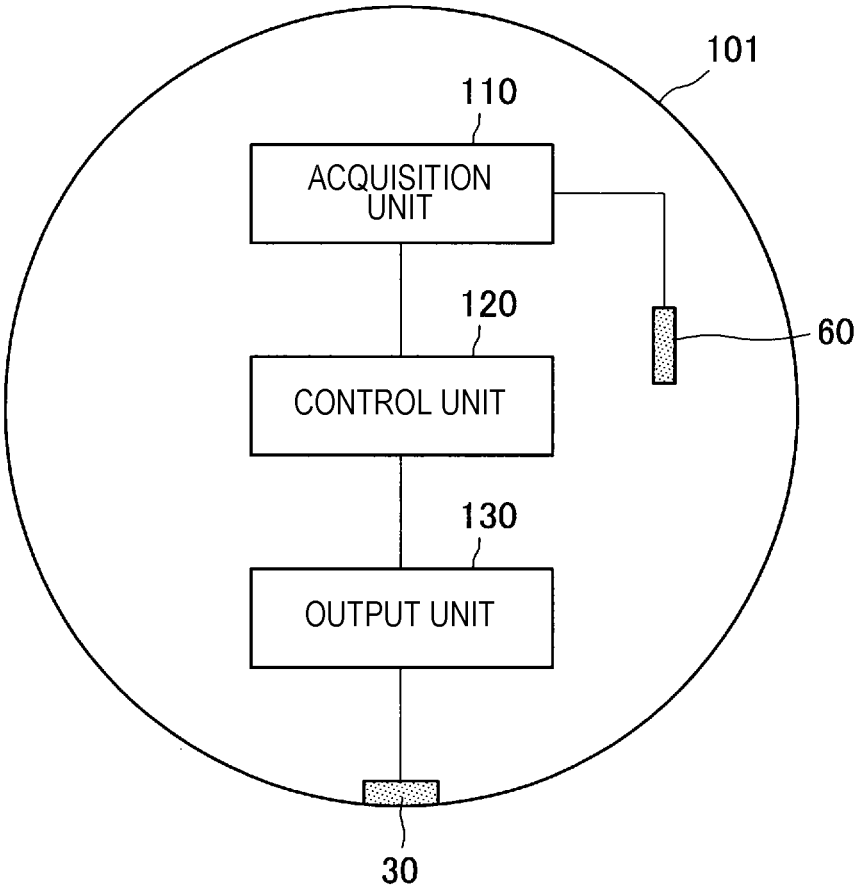
FIG. 9 is an explanatory diagram illustrating a modification of the embodiment of the present disclosure.

FIG. 9 is an explanatory diagram illustrating a modification of the embodiment of the present disclosure. FIG. 9 illustrates an example in which the speaker 30 is installed in the surface of a ball 101, and a sensor 60, the acquisition unit 110, the control unit 120, and the output unit 130 are installed in the ball 101. The acquisition unit 110, the control unit 120, and the output unit 130 are the structural elements of the signal processing device 100 illustrated in FIG. 2. Examples of the sensor 60 include an acceleration sensor, an angular velocity sensor, a geomagnetic sensor, and the like. The control unit 120 illustrated in FIG. 9 performs a signal process on a waveform signal output from the sensor 60, and generates a sound signal for outputting sound that exaggerates movement of the ball 101 from the speaker 30.

As illustrated in FIG. 9, the speaker 30 is installed in the surface of the ball 101, and the sensor 60, the acquisition unit 110, the control unit 120, and the output unit 130 are installed in the ball 101, the acquisition unit 110, the control unit 120, and the output unit 130 being the structural elements of the signal processing device 100 illustrated in FIG. 2. This enables the ball 101 to output sound that exaggerates movement of the ball 101 from the speaker 30.

FIG. 8 and FIG. 9 illustrate the modifications in which the speaker 30 outputs sound that exaggerates movement of the ball 101. However, needless to say, the object for outputting the sound that exaggerates movement from the speaker 30 is not limited to the ball. In addition, FIG. 8 and FIG. 9 illustrates an example in which the acquisition unit 110, the control unit 120, and the output unit 130 that are the structural elements of the signal processing device 100 are installed in the ball 101. However, the present disclosure is not limited thereto. The ball 101 may transmit the sound collected by the speaker 30 illustrated in FIG. 8 to the signal processing device 100 via wireless communication, and the signal processing device 100 may perform the signal process on the sound collected by the speaker 30, and transmit the signal subjected to the signal process to the ball 101 or an object other than the ball 101.

2. Conclusion

As described above, according to the embodiment of the present disclosure, there is provided the signal processing device 100 configured to perform a sound signal process on a waveform of a signal generated on the basis of movement of an object, and cause sound corresponding to the signal generated on the basis of the sound signal process, to be output within a predetermined period of time, or preferably in almost real time.

For example, as the signal generated on the basis of the movement of the object, the signal processing device 100 according to the embodiment uses a signal of sound generated from contact, collision, or the like between objects, and performs the sound signal process on a waveform of the signal.

The signal processing device 100 according to the embodiment is capable of aurally-exaggerating movement of an object itself and providing the aurally-exaggerated movement of the object by performing a sound signal process on a waveform of a signal generated on the basis of the movement of the object and causing sound corresponding to a signal generated on the basis of the sound signal process to be output within a predetermined period of time, or preferably in almost real time.

It may not be necessary to chronologically execute respective steps in the process, which is executed by each device described in this specification, in the order described in the sequence diagram or the flowchart. For example, the respective steps in the process which is executed by each apparatus may be processed in an order different from the order described in the flowchart, and may also be processed in parallel.

In addition, it is also possible to create a computer program for causing hardware such as a CPU, ROM, and RAM, which are embedded in each device, to execute functions equivalent to the configuration of each device. Moreover, it is also possible to provide a storage medium having the computer program stored therein. In addition, respective functional blocks illustrated in the functional block diagrams may be implemented by hardware or hardware circuits, such that a series of processes may be implemented by the hardware or the hardware circuits.

Further, some or all functional blocks illustrated in the functional block diagrams used in the above description may be implemented by a server device connected via a network such as the Internet. Further, each of the functional blocks illustrated in the functional block diagrams used in the above description may be implemented by a single device or may be implemented by a system in which a plurality of devices collaborate with each other. Examples of the system in which a plurality of devices collaborate with each other include a combination of a plurality of server devices and a combination of a server device and a terminal device.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A signal processing device including a control unit configured to perform a sound signal process on a waveform of a signal generated on a basis of movement of an object, and cause sound corresponding to a signal generated on a basis of the sound signal process to be output within a predetermined period of time.

(2)

The signal processing device according to (1), in which the control unit changes content of the sound signal process in accordance with a characteristic of the object.

(3)

The signal processing device according to (2), in which the control unit estimates the characteristic of the object by using a recognition result of the object.

(4)

The signal processing device according to (3), in which the control unit learns the recognition result of the object, and changes the content of the sound signal process in accordance with the learning.

(5)

The signal processing device according to (3), in which the control unit estimates the characteristic of the object by using an image recognition result of the object.

(6)

The signal processing device according to (5), in which the control unit changes the content of the sound signal process in accordance with mass of the object as the characteristic of the object.

(7)

The signal processing device according to (5), in which the control unit changes the content of the sound signal process in accordance with a size of the object as the characteristic of the object.

(8)

The signal processing device according to (5), in which the control unit changes the content of the sound signal process in accordance with a frequency characteristic of the signal generated on the basis of the movement of the object as the characteristic of the object.

(9)

The signal processing device according to (5), in which the control unit changes the content of the sound signal process in accordance with a color of the object as the characteristic of the object.

(10)

The signal processing device according to any of (1) to (9), in which the control unit learns the signal generated on the basis of the movement of the object, and changes content of the sound signal process in accordance with the learning.

(11)

The signal processing device according to any of (1) to (10), in which the control unit performs the sound signal process on a waveform of a signal generated from contact of the object with another object.

(12)

The signal processing device according to any of (1) to (11), in which the control unit performs the sound signal process on a waveform of a signal generated from transfer of the object on a surface of another object.

(13)

The signal processing device according to any of (1) to (12), in which the control unit acquires the signal generated on the basis of the movement of the object as a sound signal collected through a microphone.

(14)

The signal processing device according to any of (1) to (12), in which the control unit acquires the signal generated on the basis of the movement of the object as a waveform signal acquired through a sensor.

(15)

A signal processing method including performing a sound signal process on a waveform of a signal generated on a basis of movement of an object, and causing sound corresponding to a signal generated on a basis of the sound signal process to be output within a predetermined period of time.

(16)

A computer program causing a computer to perform a sound signal process on a waveform of a signal generated on a basis of movement of an object, and cause sound corresponding to a signal generated on a basis of the sound signal process to be output within a predetermined period of time.

REFERENCE SIGNS LIST

10 table
20 microphone
30 speaker
40 imaging device
100 signal processing device
101 ball

The invention claimed is:

1. A signal processing device, comprising:

a microphone configured to capture a first sound signal generated based on a contact of a first object with a surface; and a control unit configured to:

execute a signal processing operation on a waveform of the captured first sound signal;

change content of the signal processing operation based on a characteristic of the first object;

generate a second sound signal based on the executed signal processing operation; and output the generated second sound signal within a threshold period of time.

2. The signal processing device according to claim 1, wherein the control unit is further configured to estimate the characteristic of the first object based on a recognition result of the first object.

3. The signal processing device according to claim 2, wherein the control unit is further configured to:

store the recognition result of the first object; and change the content of the signal processing operation based on the stored recognition result.

4. The signal processing device according to claim 2, wherein the control unit is further configured to estimate the characteristic of the first object based on an image recognition result of the first object.

5. The signal processing device according to claim 1, wherein the control unit is further configured to change the content of the signal processing operation based on mass of the first object.

6. The signal processing device according to claim 1, wherein the control unit is further configured to change the content of the signal processing operation based on a size of the first object.

7. The signal processing device according to claim 1, wherein the control unit is further configured to change the content of the signal processing operation based on a frequency characteristic of the captured first sound signal.

8. The signal processing device according to claim 1, wherein the control unit is further configured to change the content of the signal processing operation based on a color of the first object.

9. The signal processing device according to claim 1, wherein the control unit is further configured to execute the signal processing operation on a waveform of a third sound signal generated from a contact of the first object with a second object.

10. The signal processing device according to claim 1, wherein the control unit is further configured to execute the signal processing operation on a waveform of a third sound signal generated from transfer of the first object on a surface of a second object.

11. The signal processing device according to claim 1, further comprising a sensor configured to acquire a waveform signal corresponding to movement of the first object.

12. A signal processing method, comprising capturing a first sound signal generated based on a contact of an object with a surface;

executing a signal processing operation on a waveform of the captured first sound signal;

changing content of the signal processing operation based on a characteristic of the object;

generating a second sound signal based on the executed signal processing operation; and outputting the generated second sound signal within a threshold period of time.

13. A non-transitory computer-readable media having stored thereon, computer-executable instructions which, when executed by a computer, cause the computer to execute operations, the operations comprising:

capturing a first sound signal generated based on a contact of an object with a surface;

executing a signal processing operation on a waveform of the captured first sound signal;

changing content of the signal processing operation based on a characteristic of the object;

generating a second sound signal based on the executed signal processing operation; and outputting the generated second sound signal within a threshold period of time.

* * * * *